United States Patent [19]

Takeshima et al.

[11] 4,439,898

[45] Apr. 3, 1984

[54] SLIDE FASTENER STRINGER

[75] Inventors: Kiyoshi Takeshima, Namerikawa; Akira Hasegawa, Kurobe, both of Japan

[73] Assignee: Yoshida Kogyo K. K., Tokyo, Japan

[21] Appl. No.: 498,721

[22] Filed: Jun. 1, 1983

Related U.S. Application Data

[63] Continuation of Ser. No. 331,269, Dec. 16, 1981.

[30] Foreign Application Priority Data

Dec. 26, 1980 [JP] Japan ..... 55-188386

[51] Int. Cl.[3] ..... A44B 19/30

[52] U.S. Cl. ..... 24/401

[58] Field of Search ..... 24/205.13 R, 205.13 D, 24/205.16 R, 205.12

[56] References Cited

U.S. PATENT DOCUMENTS

| | | | |
|---|---|---|---|
| 2,496,925 | 2/1950 | Winterhalter | 24/205.13 R |
| 3,414,948 | 12/1968 | Cuckson et al. | 24/205.13 |
| 3,874,038 | 4/1975 | Takamatsu | 24/205.13 R |
| 3,885,273 | 5/1975 | Heimberger | 24/205.13 R |
| 4,033,014 | 7/1977 | Manning | 24/205.13 D |
| 4,140,157 | 2/1979 | Scott | 24/205.13 R |
| 4,290,175 | 9/1981 | Moertel | 24/205.13 D |

*Primary Examiner*—Gene Mancene
*Assistant Examiner*—Kris R. Schulze
*Attorney, Agent, or Firm*—Hill, Van Santen, Steadman & Simpson

[57] ABSTRACT

A slide fastener stringer having a continuous thermoplastic molded coupling element strip attached to a longitudinal edge of a tape. The strip includes a row of spaced coupling elements interconnected by a pair of series of first and second thermoplastic molded connecting portions. Each first connecting portion extends between first legs of two adjacent coupling elements and each second connecting portion extends between second legs of two adjacent coupling elements. A pair of connector threads extends parallel to the first and second connecting portions, respectively, along the full length of the strip and is embedded in the first and second legs, respectively, of each coupling element.

3 Claims, 11 Drawing Figures

SLIDE FASTENER STRINGER

This application is a continuation of application Ser. No. 331,269, filed Dec. 16, 1981.

BACKGROUND OF THE INVENTION

1. Field of the Invention:

The present invention relates to slide fasteners, and more particularly to a slide fastener stringer having a continuous strip of thermoplastic molded coupling elements attached to a stringer tape along a longitudinal edge thereof.

2. Prior Art:

Various slide fastener stringers are known in which a continuous strip of thermoplastic molded coupling elements interconnected by a pair of embedded connector threads is attached to a stringer tape along a longitudinal edge thereof. The molded coupling elements are continuously made on a die wheel having in its periphery an endless series of transverse cavities. The die wheel also has in the periphery a pair of annular grooves for receiving the connector threads intersecting the transverse cavities on opposite sides thereof. After having been bent into a U-shaped cross section, the molded coupling elements are attached to the tape by sewing stitches, a weft thread of the tape, or the like. Both the sewing stitches and the weft thread have a succession of loops disposed along one longitudinal tape edge, each loop encircling the connector threads between an adjacent pair of the coupling elements, thereby securing the coupling element to said one longitudinal tape edge. However, since the only connection between the coupling elements is the connector threads, which are too flexible, only unstable attachment of the coupling elements to the tape can be achieved. This unstable attachment produces inferior slide fastenre stringers with non-uniform spaces between the coupling elements. The prior art is exemplified by U.S. Pat. Nos. 3,414,948 and 4,033,014.

SUMMARY OF THE INVENTION

A continuous row of spaced thermoplastic molded coupling elements is interconnected by a pair of series of first and second thermoplastic molded connecting portions, each coupling element having a first and a second leg extending from a head. Each of the first connecting portions extends between an adjacent pair of the first legs, and each of the second connecting portions extends between an adjacent pair of the second legs. A pair of connector threads extends transversely of the coupling elements along the full length of the coupling element row and is embedded in the first and second legs, respectively, of each coupling element, each of the connector threads is parallel to and spaced from the pair of series of first and second connecting portions, toward the respective heel side of the first and second legs. The centerline of each series of the first and second connecting portions extends through the center of the individual coupling element about which the latter is angularly moved when a stringer is engaged and disengaged with a mating stringer by a slider to open and close the slide fastener.

It is accordingly an object of the invention to provide a slide fastener stringer in which a row of spaced molded coupling elements is attached to a tape with adequate firmness and is hence free from non-uniform spaces therebetween.

Another object of the invention is to provide a slide fastener stringer having a desired degree of flexibility which enables smooth movement of a slider on the slide fastener, at which time a row of molded coupling elements is bent arcuately away from the coupling elements on a mating stringer in conformity with the Y-shaped guide channel of the slider.

Many other advantages, features and additional objects of the present invention will become manifest to those versed in the art upon making reference to the detailed description and the accompanying drawings in which several preferred embodiments incorporating the principals of the present invention are shown by way of illustrative example.

DETAILED DESCRIPTION

Figure 1:
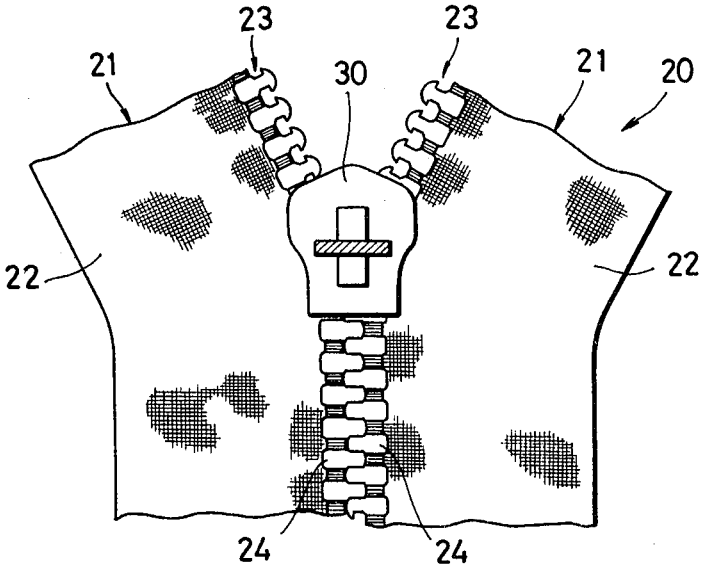
FIG. 1 is a fragmentary plan view of a slide fastener including a pair of fastener stringers each employing the present invention.

As shown in FIG. 1, a slide fastener 20 comprises a pair of stringers 21, 21 each including stringer tape 22 and a continuous thermoplastic molded coupling element strip 23 attached to the tape 22 along a longitudinal edge thereof, the strip 23 being folded on itself along its longitudinal centerline as described below.

Figure 2:
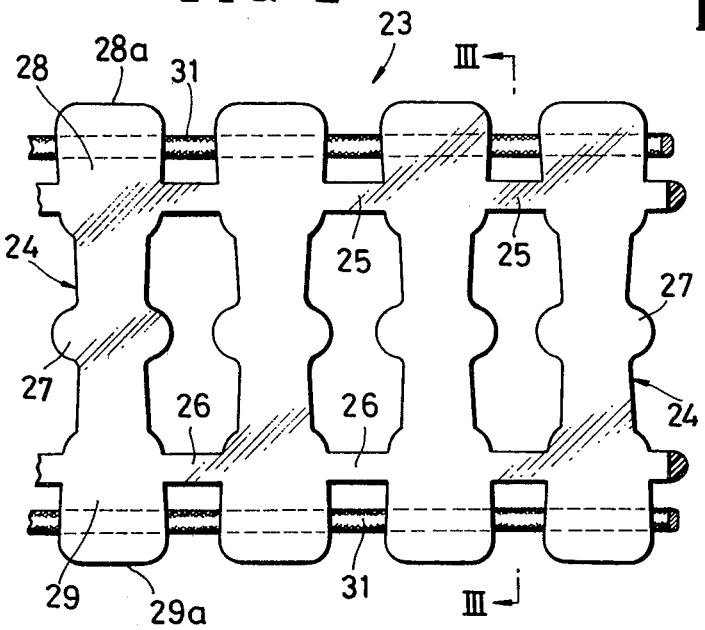
FIG. 2 is a fragmentary plan view of a continuous molded coupling element strip as it lies flat before being folded on itself along its longitudinal centerline.
Figure 3:
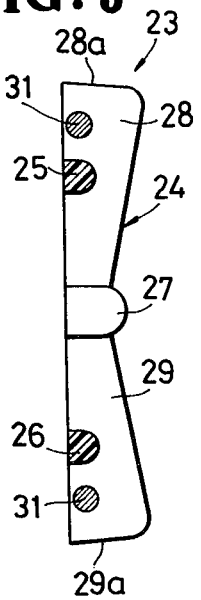
FIG. 3 is a cross-sectional view taken along line III—III of FIG. 2.

The coupling element strip 23 is continuously produced on a die wheel (not shown) having an endless ladder-shaped peripheral cavity and, before having been bent into a U-shaped cross section (FIG. 5), it has a continuous flat ladder-shaped structure as shown in FIGS. 2 and 3. The coupling element strip 23 includes a succession of laterally spaced coupling elements 24 interconnected by a pair of series of first and second connecting portions 25,26. Each of the coupling elements 24 has a head 27 and a first and a second leg 28,29 extending from the head 27 in opposite directions and terminating in their respective heels *28a*,*29a*. Each of the first connecting portions 25 extends between an adjacent pair of the first legs 28, and each of the second connecting portions 26 extends between an adjacent pair of the second legs 29. The coupling element strip 23 of FIGS. 2 and 3 is then folded on itself along its longitudinal centerline until the first and second legs 28,29 are brought closely to each other at the respective heels 28a,29a thereof (FIG. 5).

Figure 5:
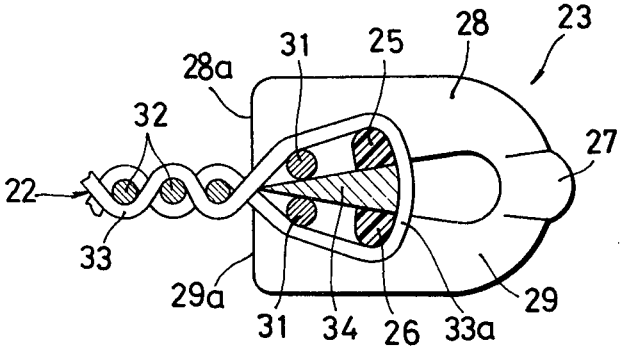
FIG. 5 is a cross-sectional view taken along line V—V of FIG. 4.
Figure 6:
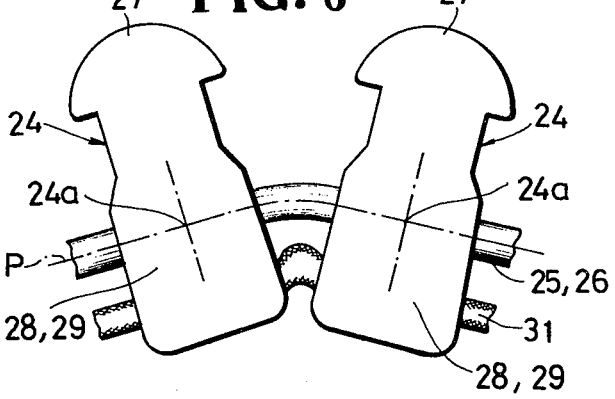
FIG. 6 is a fragmentary plan view of the folded coupling element strip, showing the manner in which the individual coupling element is angularly moved as the strip is bent.

As shown in FIGS. 3 and 5, each of the connecting portions 25,26 has a thickness smaller than the thickness of one of the legs 28,29. The centerline p of each series of the first and second connecting portions 25,26 extends through the center 24a (FIG. 6) of the individual coupling element 24 about which the latter is angularly moved when the stringer 21 is engaged and disengaged with a mating stringer 21 by a slider 30 (FIG. 1) to close and open the slide fastener 20.

A pair of connector threads 31,31 extends transversely of the coupling elements 24 along the full length of the strip 23 and is embedded in the first and second legs 28,29, respectively, of each coupling element 24 simultaneously with the molding of the strip 23. The connector threads 31, 31 are parallel to and spaced from the pair of series of first and second connecting portions 25,26, toward the respective heel side of the first and second legs 28,29. An elongate pad 34 extends in and through the folded coupling element strip 23 along the full length thereof.

Figure 4:
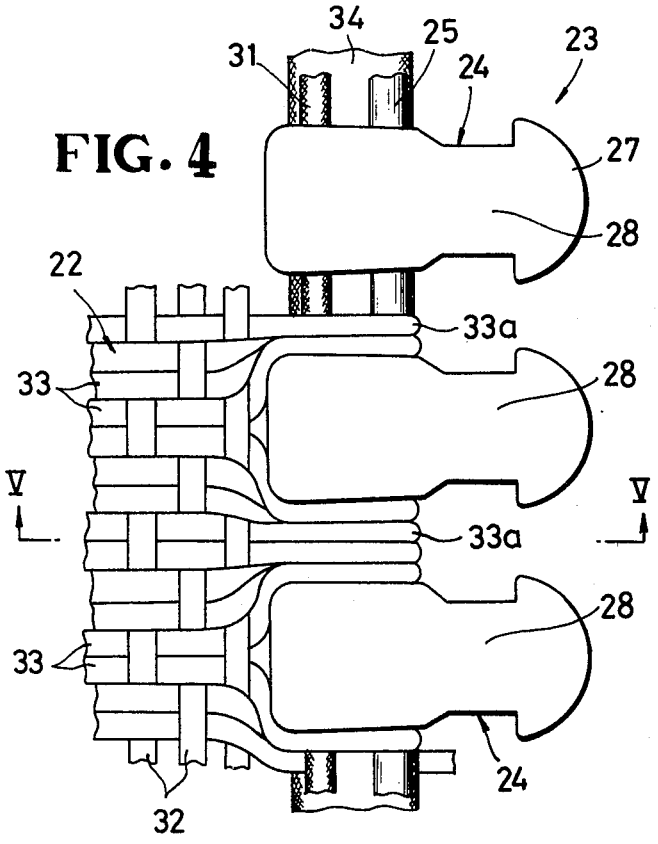
FIG. 4 is an enlarged fragmentary plan view of one of the stringers of FIG. 1, showing the folded coupling element strip secured to a stringer tape by a weft thread thereof according to a first embodiment.

The coupling element strip 23 thus produced is attached to the longitudinal edge of the stringer tape 22 as the latter is woven in a known manner. As shown in FIGS. 4 and 5, the woven stringer tape 22 includes a plurality of warp threads 32 and a weft thread 33 having a succession of loops 33a disposed along the longitudinal tape edge, each loop 33a encircling the first and second connecting portions 25,26 and the connector threads 31,31 between an adjacent pair of the coupling elements 24, thereby securing the coupling element 24 to the longitudinal tape edge.

This arrangement produces the following advantageous results. Since every pair of the coupling elements 24 is interconnected by a pair of the thermoplastic molded connecting portions 25,26, which is inextensible, proper and uniform spaces between the coupling elements 24 are guaranteed irrespective of the number of the weft thread loops 33a between each pair of the coupling elements 24. Further, partly because the center line p (FIG. 6) of each series of the first and second connecting portions 25,26 extends through the center 24a of the angular movement of the individual coupling element 24 and partly because the connector threads 31,31, which are flexible, extend along the connecting portions 25,26 on the heel side thereof, the coupling element strip 23 is allowed to bend arcuately away from the strip 23 of a mating stringer 21 in conformity with the Y-shaped guide channel of the slider 30 (FIG. 1) as the stringers 21,21 are engaged and disengaged by the slider 30 to open and close the slide fastener, thus enabling smooth threading of the coupling element strips 23,23 into and out of the slider's guide channel. In addition, because of the thermoplastic connecting portions 25,26, which have an adequate degree of rigidity, it is possible to secure the coupling element strip 23 to the longitudinal tape edge with an increased degree of firmness.

Figure 7:
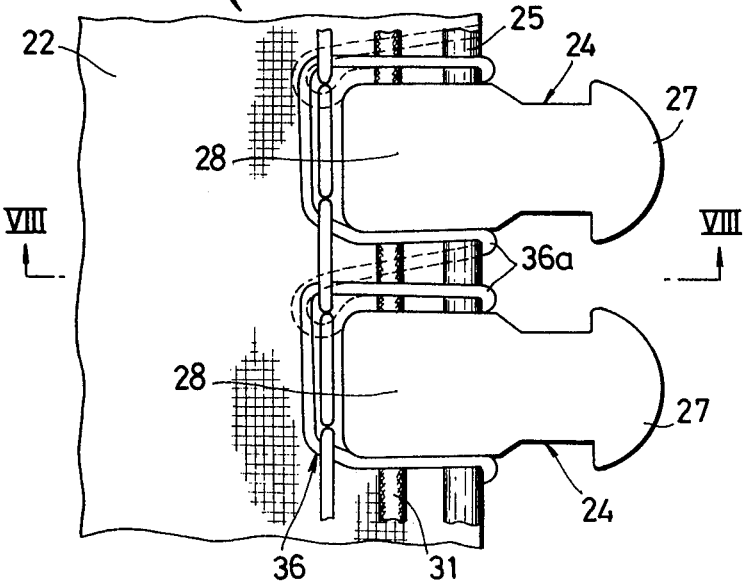
FIG. 7 is a fragmentary plan view of a modified slide fastener stringer according to a second embodiment.
Figure 8:
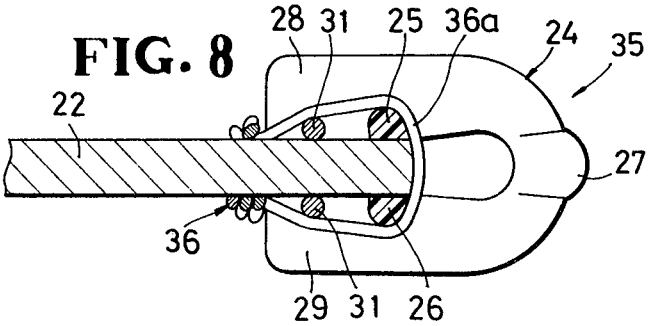
FIG. 8 is a cross-sectional view taken along line VIII—VIII of FIG. 7.

FIGS. 7 and 8 illustrate modified slide fastener stringer 35 in which a sewing thread 36 is used to attach the coupling element strip 23 to the stringer tape 22. The sewing thread 36 has a succession of loops 36a disposed along the longitudinal edge of the tape 22. Each of the loops 36a encircles the first and second connecting portions 25,26 and the connector threads 31,31 between an adjacent pair of the coupling elements 24, thereby securing the coupling elements 24 to the longitudinal tape edge. The stringer 35 produces the same results as the embodiment of FIGS. 4 and 5.

Figure 9:
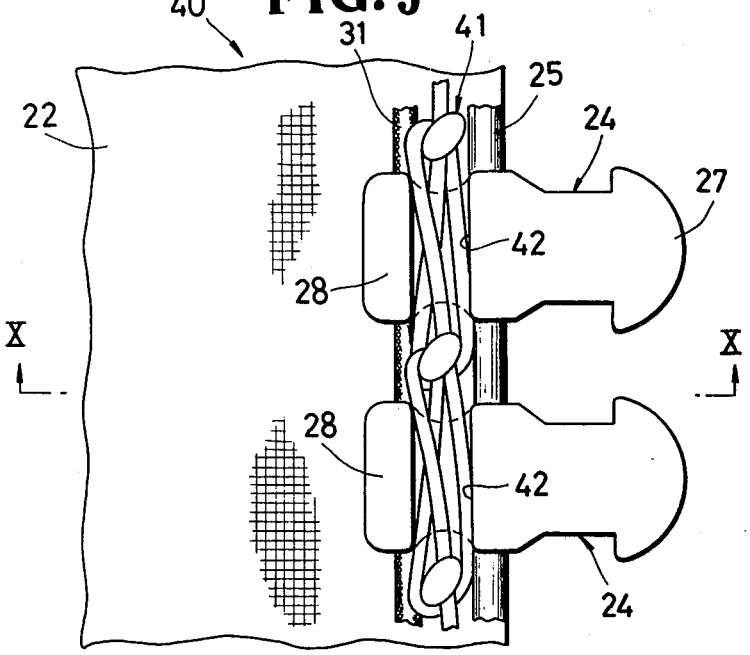
FIG. 9 is a fragmentary plan view of a modified slide fastener stringer according to a third embodiment.
Figure 10:
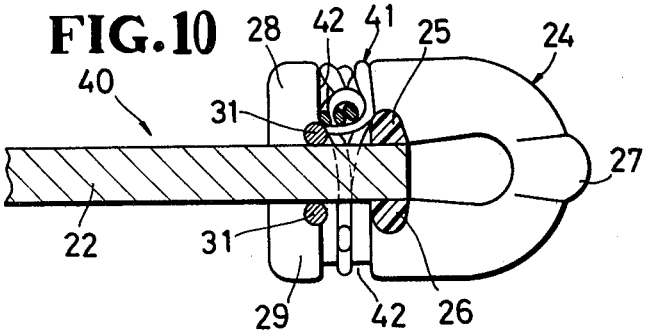
FIG. 10 is a cross-sectional view taken along line X—X of FIG. 9.

FIGS. 9 and 10 illustrates another modified slide fastener stringer 40 in which the coupling element strip 23 is attached to the stringer tape 22 by means of sewing stitches 41, such as "double locked stitches". The sewing stitches 41 are interposed between the connecting portions 25,26 and the connector threads 31,31 and extend transversely across and over the first and second legs 28,29 of each coupling element 24 along the full length of the strip 23. Each coupling element 24 has a pair of grooves 42,42 extending transversely across the first and second legs 28,29, respectively, on their outer sides. The sewing stitches 41 extend through the grooves 42,42. This arrangement also produces stable attachment of the coupling element strip 23 to the tape 22.

Figure 11:
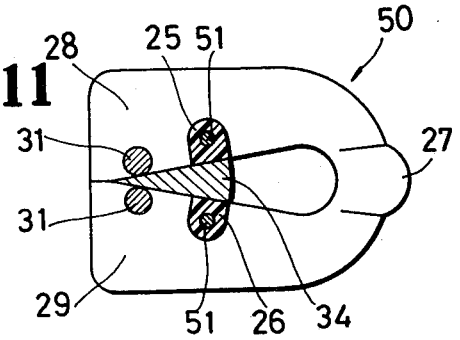
FIG. 11 is a cross-sectional view of a modified coupling element strip.

FIG. 11 illustrates a modified coupling element strip 50 similar to the strip 23 of FIG. 5 and different therefrom only in that a pair of reinforcing core threads 51,51 extends in and through the pair of series of first and second connecting portions 25,26, respectively, along the full length of the strip 50.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A slide fastener stringer comprising:

(a) a stringer tape;

(b) a molded coupling element strip of continuous thermoplastic disposed on and along one longitudinal edge of such stringer tape, said tape including a succession of laterally spaced coupling elements each having a head and a pair of first and second legs extending from said head in a common direction, and said strip including a molded single pair of series of first and second thread-free connecting portions, each of said first connecting portions extending integrally with and between an adjacent pair of said first legs, each of said second connecting portion extending integrally with and between an adjacent pair of said second legs; and (c) a pair of connector threads extending transversely of said coupling elements along the full length of said strip and lying at confronting surfaces of said first and second legs, of each said coupling element and being exposed therebetween, each of said exposed connector threads being normally parallel and spaced from a respecitve one of said pair of series of said thread-free first and second connecting portions toward the respective heel side of said first and second legs.

2. A slide fastener stringer according to claim 1, each of said series of molded first and second thread free connecting portions being connected to the adjacent coupling elements centrally between the heads and heels thereof, and adapted to be a fulcrum between said adjacent coupling elements enabling pivoting thereof in response to mating and unmating with a corresponding stringer, said exposed connector threads enabling said heels of said adjacent coupling elements to move from the free position toward each other during such pivoting.

3. A slide fastener stringer according to claim 1, further including sewing stitches interposed between said molded thread-free connecting portions and said exposed connector threads and extending transversely across and over said first and second legs of each said coupling element along the full length of said strip, each said coupling element having a pair of grooves each extending perpendicularly to the length of the stringer and transversely across both said first and second legs, respectively, on their outer sides and opening toward the adjacent coupling elements, said sewing stitches extending through said grooves.

* * * * *